US011072460B2

(12) United States Patent
Gordon

(10) Patent No.: US 11,072,460 B2
(45) Date of Patent: Jul. 27, 2021

(54) COLLAPSIBLE PALLET SYSTEM AND METHODS

(71) Applicant: Norman H. Gordon, Munster, IN (US)

(72) Inventor: Norman H. Gordon, Munster, IN (US)

( * ) Notice: Subject to any disclaimer, the term of this patent is extended or adjusted under 35 U.S.C. 154(b) by 0 days.

(21) Appl. No.: 16/761,991

(22) PCT Filed: Nov. 7, 2018

(86) PCT No.: PCT/US2018/059613

§ 371 (c)(1),
(2) Date: May 6, 2020

(87) PCT Pub. No.: WO2019/094460

PCT Pub. Date: May 16, 2019

(65) Prior Publication Data

US 2020/0317398 A1 Oct. 8, 2020

Related U.S. Application Data

(60) Provisional application No. 62/582,411, filed on Nov. 7, 2017, provisional application No. 62/609,019, filed
(Continued)

(51) Int. Cl.
*B65D 19/00* (2006.01)

(52) U.S. Cl.
CPC ..... *B65D 19/0073* (2013.01); *B65D 2203/10* (2013.01); *B65D 2519/00019* (2013.01);
(Continued)

(58) Field of Classification Search
CPC ..... B65D 19/00; B65D 19/2519; B65D 19/00019; B65D 19/00054;
(Continued)

(56) References Cited

U.S. PATENT DOCUMENTS 2,709,559 A * 5/1955 Geisler ..... B65D 19/0028 108/51.3
2,894,671 A * 7/1959 Nicholls ..... B65D 19/20 206/386
(Continued)

FOREIGN PATENT DOCUMENTS

JP 06239346 A * 8/1994
WO WO-9823441 * 6/1998 ..... B65D 19/00
(Continued)

*Primary Examiner* — Jose V Chen
(74) *Attorney, Agent, or Firm* — Valauskas Corder LLC

(57) ABSTRACT

A lightweight pallet assembly comprising a hybrid of durable corrugated material and heat-treated wood bonded with industrial strength adhesive. The pallet is constructed of one or more base components, two or more support components and a sleeve component. The sleeve component substantially covers both the one or more base components and the two or more support components to increase strength and durability of the overall pallet assembly. Embodiments of the pallet can be quickly assembled from components that can be easily and economically stored and transported. The lightweight pallet provides savings in assembly, transportation, and storage.

12 Claims, 15 Drawing Sheets

Related U.S. Application Data on Dec. 21, 2017, provisional application No. 62/674,829, filed on May 22, 2018, provisional application No. 62/744,778, filed on Oct. 12, 2018.

(52) U.S. Cl.
CPC ..... *B65D 2519/00029* (2013.01); *B65D 2519/00044* (2013.01); *B65D 2519/00054* (2013.01); *B65D 2519/00064* (2013.01); *B65D 2519/00079* (2013.01); *B65D 2519/00273* (2013.01); *B65D 2519/00293* (2013.01); *B65D 2519/00323* (2013.01); *B65D 2519/00333* (2013.01); *B65D 2519/00562* (2013.01)

(58) Field of Classification Search
CPC ..... B65D 19/00089; B65D 19/00124; B65D 19/00562; B65D 2519/00019; B65D 2519/00054; B65D 2519/00089; B65D 2519/00124; B65D 2519/00562
USPC ..... 108/51.3, 57.19
See application file for complete search history.

(56) References Cited

U.S. PATENT DOCUMENTS 2,904,297 A * 9/1959 Hamilton ..... B65D 19/0095 108/51.3
2,913,206 A * 11/1959 Paris ..... B65D 19/36 206/386
2,997,266 A * 8/1961 Munroe ..... B65D 19/0028 108/51.3
3,236,197 A * 2/1966 Rossner ..... B65D 19/20 108/51.3
3,268,147 A * 8/1966 Burger ..... B65D 5/002 229/191
4,303,020 A * 12/1981 Houle ..... B65D 19/0016 108/51.3
4,936,229 A * 6/1990 Parnell ..... B65D 19/0012 108/51.3
5,207,631 A * 5/1993 Schmidtke ..... B31D 5/00 493/334
5,230,291 A * 7/1993 Juvik-Woods ..... B65D 19/0012 108/51.3
5,272,989 A * 12/1993 Johnston ..... B65D 19/0026 108/51.3
5,285,731 A * 2/1994 McIntyre ..... B65D 19/0026 108/51.3
5,285,732 A * 2/1994 Gottlieb ..... B65D 19/0018 108/51.3
5,427,019 A * 6/1995 Moorman ..... B65D 19/0026 108/51.3
5,465,672 A * 11/1995 Boyse ..... B65D 19/0012 108/51.3
5,660,118 A * 8/1997 Adams, Jr. ..... B65D 19/38 108/51.3
5,996,509 A * 12/1999 Lai ..... B65D 19/0012 108/51.3
7,426,890 B2 * 9/2008 Olvey ..... B65D 19/0036 108/51.3
7,980,184 B2 * 7/2011 Olvey ..... B65D 19/0012 108/51.3
8,146,515 B2 * 4/2012 Trickett ..... B65D 19/36 108/55.5
8,221,869 B2 * 7/2012 Pare ..... B65D 71/0096 428/126
8,316,779 B2 * 11/2012 Gordon ..... B65D 19/20 108/51.3
8,701,569 B2 * 4/2014 Linares ..... B65D 19/0026 108/51.3
2002/0069796 A1 * 6/2002 Olvey ..... B65D 19/0059 108/56.1
2005/0241549 A1 * 11/2005 Gordon ..... B65D 77/003 108/51.3
2006/0225626 A1 * 10/2006 Olvey ..... B65D 19/0012 108/51.3
2007/0068426 A1 * 3/2007 Teags ..... B65D 19/0028 108/51.3
2007/0107639 A1 * 5/2007 Dixon ..... B65D 19/0014 108/51.3
2007/0289504 A1 * 12/2007 Harp ..... B65D 19/0012 108/51.3
2008/0011204 A1 * 1/2008 Borggaard ..... B65D 19/0014 108/51.3
2008/0163800 A1 * 7/2008 Reilly ..... B65D 19/40 108/51.3
2008/0196633 A1 * 8/2008 Ho ..... B65D 71/70 108/51.3
2009/0301908 A1 * 12/2009 Takahashi ..... H05K 7/1488 206/229
2010/0011999 A1 * 1/2010 Harp ..... B65D 19/0012 108/51.3
2011/0308993 A1 * 12/2011 Hill ..... B65D 19/20 206/600
2015/0197368 A1 * 7/2015 Casey ..... B65D 19/38 108/51.3
2017/0107011 A1 * 4/2017 Melland ..... A63C 17/01
2018/0141703 A1 * 5/2018 Herbeck ..... B65D 19/20
2018/0244430 A1 * 8/2018 Berkes ..... B65D 19/0073

FOREIGN PATENT DOCUMENTS

WO WO-2011003126 A1 * 1/2011 ..... B65D 19/18
WO WO-2015191713 A1 * 12/2015 ..... B65D 19/0095
WO WO-2017179985 A1 * 10/2017 ..... B65D 19/0016
WO WO-2018146502 A1 * 8/2018 ..... B65D 19/0026

* cited by examiner

COLLAPSIBLE PALLET SYSTEM AND METHODS

This application claims the benefit of U.S. Provisional Application No. 62/582,411 filed Nov. 7, 2017, U.S. Provisional Application No. 62/609,019 filed Dec. 21, 2017, U.S. Provisional Application No. 62/674,829 filed May 22, 2018, and U.S. Provisional Application No. 62/744,778 filed Oct. 12, 2018.

FIELD OF THE INVENTION

The present invention relates to a lightweight pallet comprising a hybrid of durable corrugated material and heat-treated wood bonded with industrial strength adhesive.

BACKGROUND OF THE INVENTION

Pallets are platforms for supporting weight thereon, and by which materials, packages, or goods that are stacked thereon may be handled, stored and/or moved. Goods positioned on pallets are typically moved and stored in warehouses, factories, or vehicles, for example, by forklift equipment, in which the forklift tines are inserted into channels in the pallet or by way of engagement with an undersurface of a top deck of the pallet.

Pallets have traditionally been formed entirely from wood. Although wood pallets remain the most popular, they come with a variety of issues.

First, US standard GMA 48"×40" pallets weigh 40-50 pounds or more. This affects freight shipping such as air cargo and LTL (Less-Than-Truckload) shipping, where extra pounds mean higher costs. Due to their weight, wood pallets are responsible for a significant waste of fuel. Another weight-related concern is that wood pallets are difficult for workers to carry. Often they must use forklifts merely to move empty pallets around a warehouse floor. Or employees might decide against using pallets for peripheral functions because it's just not worth the effort.

Second, after initial use, many wood pallets require repair, are relegated to carrying much lighter loads, or are junked. After their initial use, many wood pallets require repair, are relegated to carrying much lighter loads, or are junked. Others suffer all-too-common run-ins with forklifts, leaving them damaged. Oftentimes consumers buy used pallets and discard them after a single trip.

Third, because they are cheap and not always sturdy, wood pallets are often treated as throwaway items. Consequently, wood pallets occupy an estimated 2-3% of landfill space in the US (according to the USDA Forest Service). Pallets are also popular fuel for bonfires. Although some cities have outlawed or placed restrictions on this practice, in the meantime these pallets are sent to the landfill.

Fourth, wood pallets are vulnerable to invasive insects and plant diseases. Consequently, they are a poor choice for the shipment and storage of food products and pharmaceuticals. To fight disease, the International Plant Protection Convention prohibits untreated wood pallets from crossing national borders. To prepare for overseas use, pallet vendors must treat their products with heat or chemical fumigation, or make them from something other than wood. Costly, heavy plastic is the usual alternative. Corrugated and lightweight plastic handle more modest loads and don't rack.

As mentioned above, wood pallets are heavy which may lead to back and neck injuries. But they may also cause splinters. In addition, wood pallets use nails or staples, which present their own hazards to both employees and freight. All these factors contribute to workplace injuries and product damage.

Lastly, wood or plastic pallets are typically provided in a fully erected or constructed state and not deconstructed when not in use and therefore always require a maximum amount of space.

Between extra fuel costs, environmental concerns, and workplace injuries, wood pallets are becoming a major headache. But there's a reason why no alternative has taken hold. Metal pallets are strong, but very heavy and expensive. Sturdy plastic pallets have a long life, but are far costlier than wood and not much lighter. Corrugated pallets are lighter than wood, but most can't rack and don't stand up to the rigors of shipping or warehouse handling. Despite all their deficiencies, wood pallets continue to dominate the industry.

There is a need for a pallet that fulfills these deficiencies. While a number of attempts have been made to design inexpensive, but structural dependable pallets, there continues to be a need for improvements in both cost, ease of use, and overall strength.

SUMMARY OF THE INVENTION

The invention is directed to a pallet that functions equivalently with pallets made entirely of wood, but without the many limitations. The invention is a hybrid of durable corrugated material and heat-treated wood bonded together with industrial strength adhesive. Accordingly, the pallet according to the invention can handle the loads asked of most pallets constructed entirely of wood in spite of being 50-70% lighter than the current 40-60 pounds for wood pallets. The pallet assembly according to the invention weighs approximately 23 pounds for the heavyweight GMA version, and roughly 19 and 15 respectively for the standard and lightweight models, vs. 40-60 lbs. or more for wood.

The pallet assembly according to the invention functions as a single unit, enhancing its strength and ability to cushion its cargo. It is much lighter than wood or most alternatives, and is International Standards For Phytosanitary Measures (ISPM) 15-certified resistant to infestation. The pallet assembly can optionally be customized and further include tracking components. This may facilitate seamless movement of the pallet assembly from truck to warehouse to display. And best of all, the invention may be priced competitively with new wood pallets.

An advantage of the invention is a pallet of substantially lower weight as compared to traditional wood pallets. As a result, upfront savings can be realized for LTL (Less-Than-Truckload) and air shippers. Shipments via Full Truckload (FTL) and container shipments benefit by adding more cargo to shipments before reaching weight maximums due to less pallet weight. Furthermore, more air freight can be loaded onto each plane. Freight on a flight is often limited to preserve a margin of safety. By replacing heavy wood pallets, the lighter pallets according to the invention frees up more weight for cargo on each flight. Whether carriers ultimately save on fuel or reach weight capacities with more cargo (and less pallet weight), the savings goes straight to their bottom line.

The lightweight pallet assembly also allows a user to carry it without risk of injury. And the pallet assembly has no exposed wood surface, staples, or nails such that the risk of splinters or other handling injuries is minimal. The absence of nails and staples also protects cargo.

Another advantage of the invention is its environmental credentials. Not only is it lighter weight resulting in less use of fossil fuels throughout the distribution chain, it is also reusable and recyclable. Hence it may reduce the number of pallets added to landfills each year. The pallet assembly provides a much longer life cycle than pallets constructed of wood alone. Furthermore, the pallet assembly according to the invention can be reused through the use of replacement corrugated sleeves.

The materials from which the pallet components may be made can be "environmentally friendly" and therefore present low environmental impact. The pallet of the present invention and its components may be formed or joined without the use of metal staples, nails, or other fasteners. The staples, nails or other fasteners used in constructing conventional pallets are typically environmentally "less friendly". They also may cause harm, such as to a user, when dislodged from the pallet. The use of materials other than wood for the collapsible pallet of the present invention is also economically and environmentally friendly. For example, the use of material other than wood for components of the pallet of the present invention mostly eliminates the need to fumigate the pallet in order to destroy those destructive elements, such as the longhorn beetle that are typically harbored in the wood. In addition, the collapsible pallet of the present invention can be re-used multiple times. Due to the materials used in preferred embodiments of the invention, namely cardboard and like paper-based materials, repairs can be easily made, and the present invention contemplates the inclusion of repair kits with the pallets.

The materials from which the components of the pallet may be made may be of a composition, or treated with other materials so that the components and the assembled pallet is generally insect or germ free and water resistant thereby permitting the pallet to be used in a moist or wet environment without perceptible loss in structural dependability. With components heat treated before assembly, the pallet is not vulnerable to infestation or plant diseases. It's ISPM 15-certified and ready for international use right off the assembly line. And it's safe for the transport, storage, and display of foodstuffs. The pallet may also be constructed from materials such that it is resistant to dust. Other embodiments may include components and be structured so that the pallets are fire resistant, heat resistant, anti-static, or respond to additional user transport and storage specifications.

Additionally, the material used, in the making of the pallet, may also be constructed in such a way that it offers cushioning to help absorb shock vibrations. The pallet may be erected by hand, hand and machine or machine only. This offers options in the assembly process. The pallet, if need be, can be constructed in such ways that it can be moved on conveyors or accept wheels, castors, or another roller type product for movement, or racking systems for storage or display. Components of the pallet can be formed through materials that facilitate reuse or recycling of the components or the material from which the components are made. The pallet can be constructed so that additional uses, such as add-on parts, can be added to give the platform added benefits such as display advertising, void filling, and convention type presentation. The pallet itself may be saved and recycled to use as a cost saving feature in other inventions.

Yet another advantage is that the pallet assembly can be customized with printing elements such as bar codes, holograms, logos, instructions, advertisements, etc. Informational surfaces that may be used, if desired, for informational purposes such as by being decorated by processes of printing, laminating, stamping, spraying, etc. and can offer benefits such as bar coding, assembly instructions, and advertising. The platform may carry radio frequency friendly identification devices by which information concerning, for example, ownership and use of the platform may be provided. Various parts, sections or components of the pallet may be color coded, for example, for decorative purposes or for informational purposes such as to identify the carrying capacity or special use purpose of the pallet, to identify the owner of the material carried in the pallet, the owner of the pallet, promotional or advertising purposes, or simply to facilitate the construction or deconstruction of the pallet.

Additionally, the pallet may include decorative or esthetic elements such that the pallet may be used in more public venues and not simply the warehouse. Conventional pallets, to the extent they are constructed of cardboard, have corrugated flutes. Embodiments of the present invention eliminate what may be viewed as aesthetically unappealing exposure of corrugated flutes by providing various assembly constructions such that the cross sections of the corrugated cardboard are hidden or secluded from all outside or exposed surfaces. Moreover, it is contemplated the present invention may be assembled of cardboard constructed without corrugated flutes. The singularity of sheet through a printing press means the sheet can be printed and die cut at the same time therefore saving money on many decorative operations.

According to the invention, a printer device may print content of the information surfaces or decorative or esthetic elements. Some or all the content or esthetic elements on the pallet assembly can be performed in an in-line basis as the pallet is being assembled or repaired. The selection of content can be directly controlled by purchasers or customers such as through an Internet-based service. It is contemplated that an Internet-based service provider may be affiliated or associated with technology such as that developed and used under Apple Inc.

Another advantage of the invention is tracking capability. More and more businesses insist they be able to implement state-of-the-art technology for tracking and inventory control. As an example, in early 2011, the U.S. FDA received authority to implement a mandate for electronic "farm-to-fork" traceability of all fruits and vegetables. According to the invention, a RFID tag and/or bar code can be included for these tasks and many more.

A further advantage of the invention is that it provides a tracking functionality to one or more pallets, for example, through the coordinated use of bar codes, hologram, or RFID tags (tracking devices). A bar code is a series of lines of that can be read by a computer input device, for example, a bar code scanner and provide a wide variety of information. A hologram is a three-dimensional photograph or illustration, created with an optical process that uses lasers. Holograms are difficult to replicate or counterfeit. A RFID tag, or radio frequency identification tag, is a type of electronic identification that uses radio frequency signals to read information. A tracking device may be applied to each component, larger groupings of components, or the fully assembled pallet. The tracking device can communicate a variety of information, for example, certification of the maximum weight the pallet is capable of supporting, origin, and destination of the product associated with a particular pallet along with the location at any given moment in time. It is further contemplated that the tracking device may include other sorts of information such as a customer's logo. The components of the pallet may additionally have designations by which the pallet components may be identified and tracked. Components suitable for reuse may include designations or identifications that assist one or more subsequent purchasers of the use history of that component. A corporate certification stamp backed by insurance, such as is used in the corrugated box industry, can be used to designate manufacturing guarantees such as product transport or storage warranties. In fact, one or more components of the pallet may be certified, such as in printed information including the manufacturer's or shipper's information, identification or logo to make sure that only that business' product is shipped or used with the identified pallet. This is important when quality control certification only applies when the business' given product is carried on the identified pallet. Other features will become apparent in the following description.

According to the invention, a chip inserter device positions a tracking device or tracking element such as an identification (ID) chip on the pallet assembly. The ID chip, such as an RFID tag, may be used to track the pallet assembly. A RFID tag, or radio frequency identification tag, is a type of electronic identification that uses radio frequency signals to read information. A tracking device may be applied to each component, larger groupings of components, or the fully assembled pallet. The tracking device can communicate a variety of information, for example, certification of the maximum weight the pallet is capable of supporting, origin, and destination of the product associated with a particular pallet along with the location at any given moment in time. It is also contemplated that the ID chip may include data read by a printer device. This data may identify the content to be selected from a database and printed on the pallet assembly.

Another advantage of the invention is that it is rackable. They can be stored in racks and reused. The pallet according to the invention functions as a single unit, enhancing its durability and allowing it to absorb more shocks than a wood pallet.

It is also contemplated that an Internet-based service may facilitate charges for each pallet assembly based on use including, for example fees credited for return of a pallet assembly for reuse or recycling and/or fees debited for return of a damaged pallet assembly.

The invention and its attributes and advantages may be further understood and appreciated with reference to the detailed description below of one contemplated embodiment, taken in conjunction with the accompanying drawings.

BRIEF DESCRIPTION OF THE DRAWINGS

The preferred embodiments of the invention will be described in conjunction with the appended drawings provided to illustrate and not to the limit the invention, where like designations denoted like elements, and in which.

DETAILED DESCRIPTION OF THE PREFERRED EMBODIMENTS

The present invention is directed to a pallet that is easily assembled, and from easily transported and manipulated components. The components can be varied to easily provide pallets of different size and structural dependability. Each of the components for and the assembled pallet is lightweight and uses less material than many pallets made from similar materials. This further reduces waste, lowers shipping costs and ultimately fuel consumption costs associated with the transport of the product shipped on the pallets on the issue of fuel consumption.

The modular pallet of the present invention is formed from components that can be shipped and stored in a largely flattened state. As a result, prior to assembly, a pallet according to the present invention takes up little space, thereby reducing transportation and storage costs. After assembly, for example, the pallet may be racked into the size permitted by the components, such as a space occupying 4½"×48"×42".

The pallet assembly comprises one or more base components, one or more support components, and a sleeve component. The base components and support components may be constructed from wood while the sleeve component constructed of a corrugated paperboard or cardboard sheet. However, any suitable material may be used, such as, for example, plastic or combinations of plastic and paper material or other composite materials. Also, the material may include wood, metal, or extruded recycled material.

Figure 1:
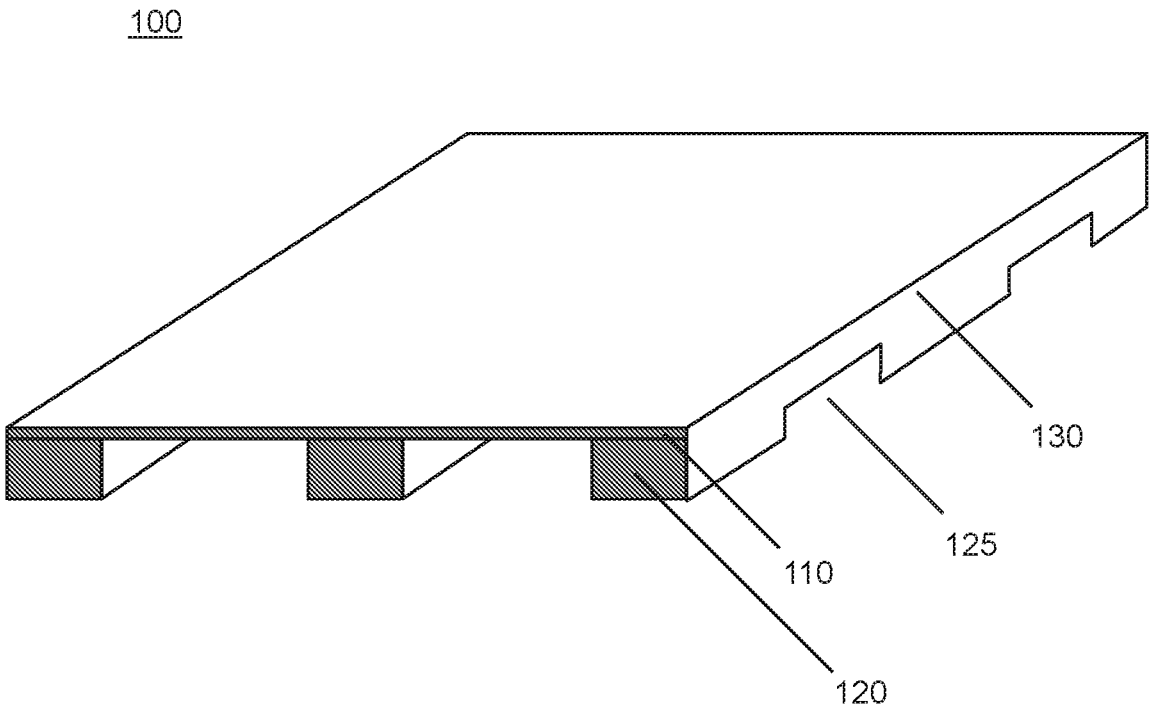
FIG. 1 illustrates a perspective view of a pallet assembly according to an embodiment of the invention.

FIG. 1 illustrates a perspective view of a pallet assembly 100 according to an embodiment of the invention. Pallet assembly 100 includes a base component 110 or top deck portion that may be constructed from a continuous flat sheet of material (FIG. 1) or from a plurality of board elements (see e.g., FIG. 7). Support components 120 are shown in FIG. 1 as three beams. The support components 120 may include a point of entry so that a fork lift truck or hand jack can be used to move and position the pallet. As shown in FIG. 1, forklift tines may be inserted within openings 125. Pallet assembly 100 may further include a sleeve component 130. Sleeve component may comprise a plurality of flaps hingedly attached to a top portion, and folded such that it is positioned around to cover the base component and support components.

Figure 2:
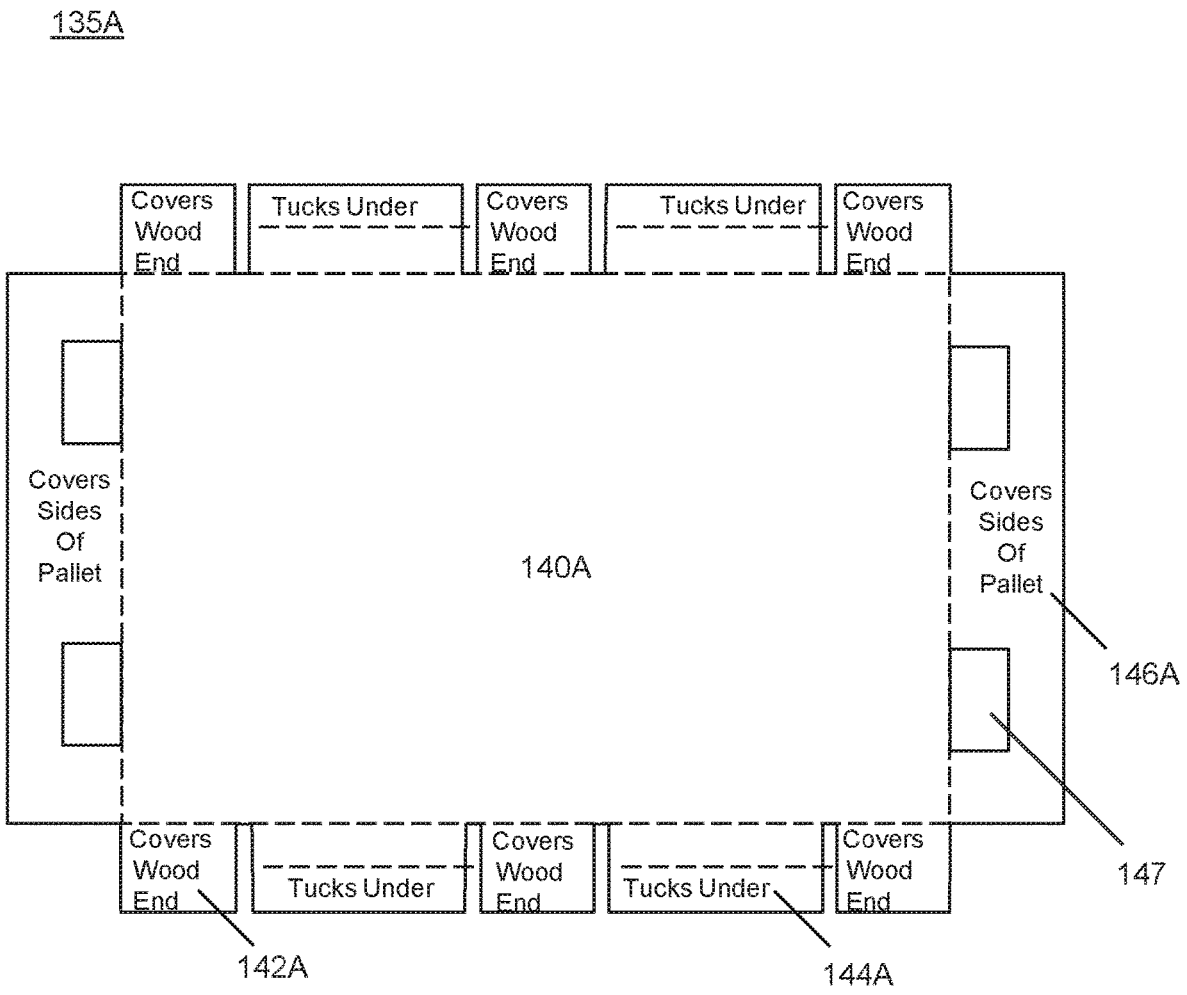
FIG. 2 illustrates a top view of a sleeve component according to an embodiment of the invention.
Figure 3:
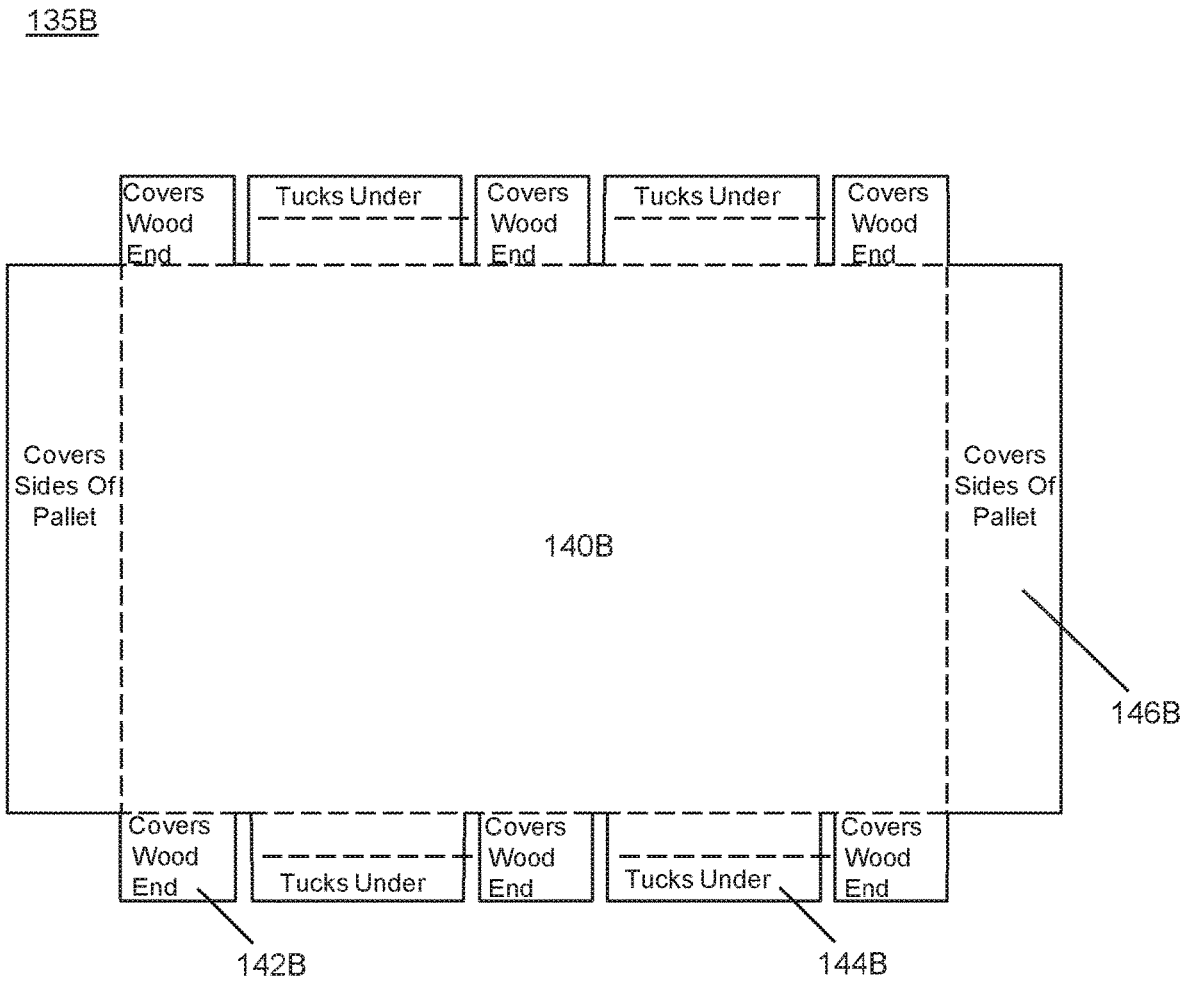
FIG. 3 illustrates a top view of a sleeve component according to another embodiment of the invention.

FIG. 2 and FIG. 3 each illustrate a top view of a sleeve component 135A, 135B, respectively. Each sleeve component 135A, 135B includes a plurality of flaps—142A, 144A, 146A and 142B, 144B, 146B—hingedly attached to a top portion 140A, 140B. Certain flaps cover the sides of the pallet assembly and certain other flaps cover the ends so that the base component and support components are not exposed.

In particular, top portion 140A, 140B of the sleeve component 135A, 135B is positioned over the top of base component. End flaps 142A, 142B are folded to cover the ends of the support components. Support flaps 144A, 144B are folded to tuck under the bottom of the pallet assembly, or positioned on the underside of the base component. Side flaps 146A, 146B are folded to cover a side of the support component, which is positioned parallel to a perimeter edge of the base component. As shown in FIG. 2, side flap 146A includes aperture elements 147 that align with openings 125 (FIG. 1) of the support components so that forklift tines may be used to move and position the pallet assembly.

Figure 4:
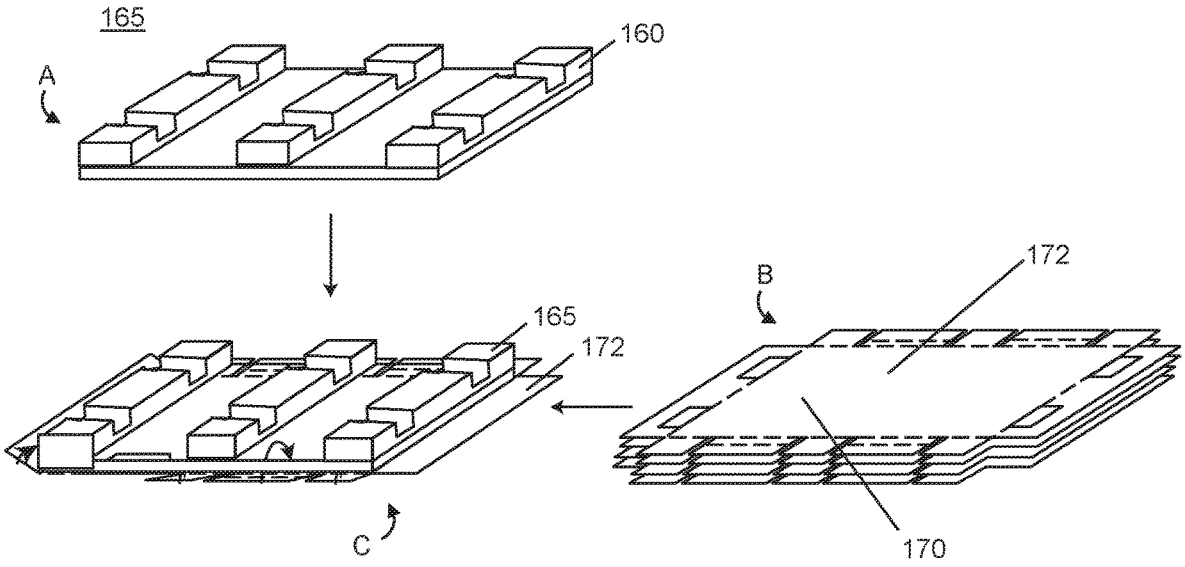
FIG. 4 illustrates a method for assembling a pallet assembly according to an embodiment of the invention.

As shown in FIG. 4, a pallet—either new or used—includes a base component 150 glued to two or more support components 150, together forming connected unit 165 (shown by "A"). Glue is applied to a sleeve component 170 in the form of a die cut corrugated sheet 172 (shown by "B"). The connected components 165 are placed on the die cut corrugated sheet 172 and the die cut corrugated sheet 172 is folded over the connected components 165 (shown by "C").

Figure 5:
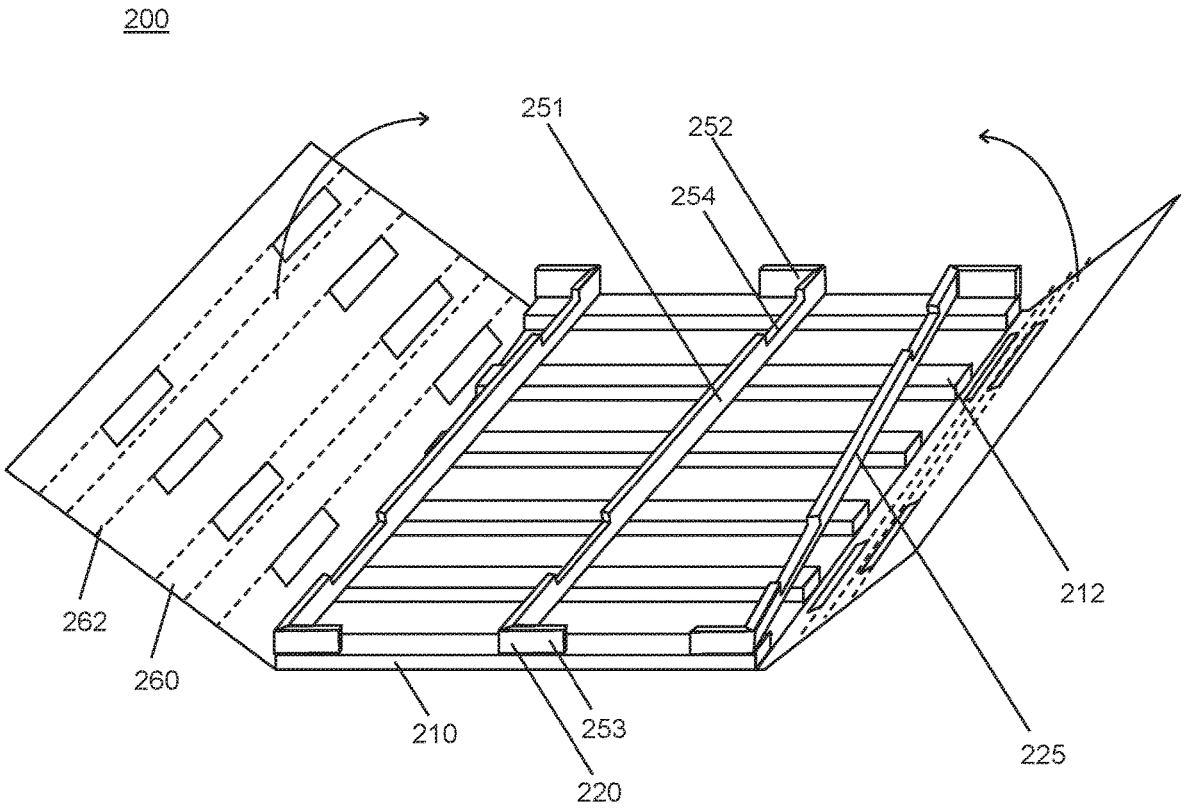
FIG. 5 illustrates a perspective view of a pallet assembly according to an embodiment of the invention.
Figure 6:
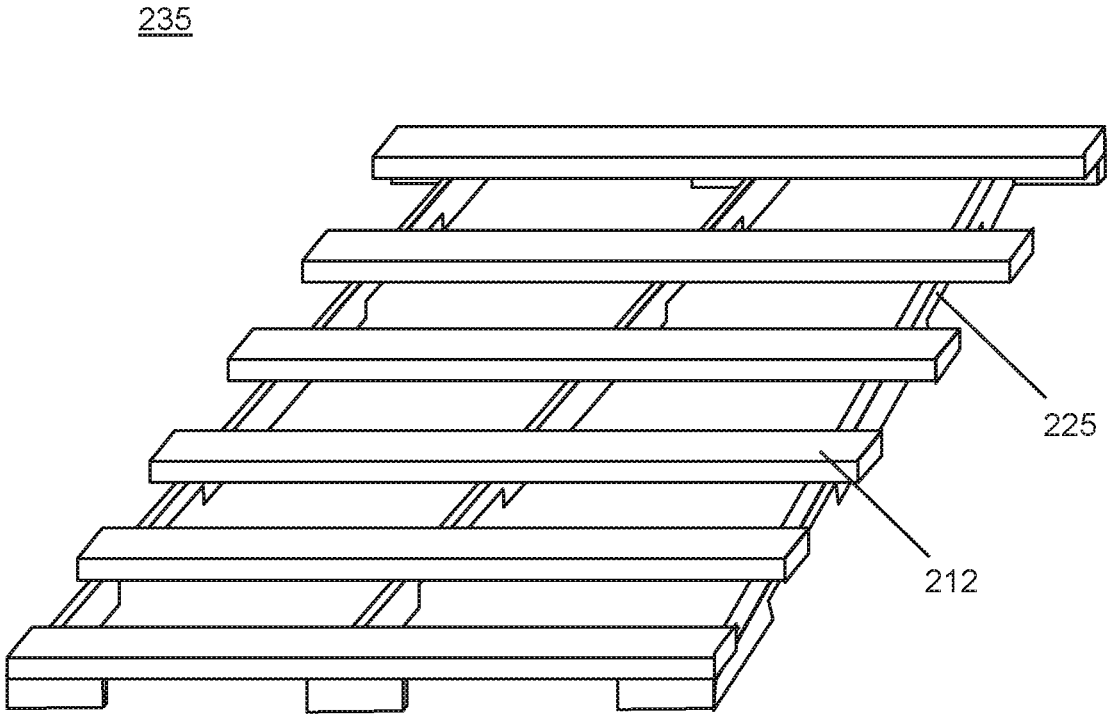
FIG. 6 illustrates a top perspective view of a connected unit according to an embodiment of the invention.

FIG. 5 illustrates a perspective view of a pallet assembly 200 according to an embodiment of the invention. Base component 210 comprises a plurality of board elements 212. Support components 220 comprise stringer elements 225, which are adhered to the plurality of board elements 212—one positioned in the center of the base component 210 and the others positioned at or along an edge of the base component 210. The plurality of board elements 212 and stringer elements 225 are adhered to create connected unit 235 as shown in FIG. 6. Turning back to FIG. 5, each stringer element 225 includes a linear element 251 connected to end portions 252, 253. Linear element 251 includes notches 254. Sleeve component 260 is a die cut corrugated sheet 262 that is placed on a top surface of the plurality of board elements 212 and folded to encase each stringer element 225.

Figure 7:
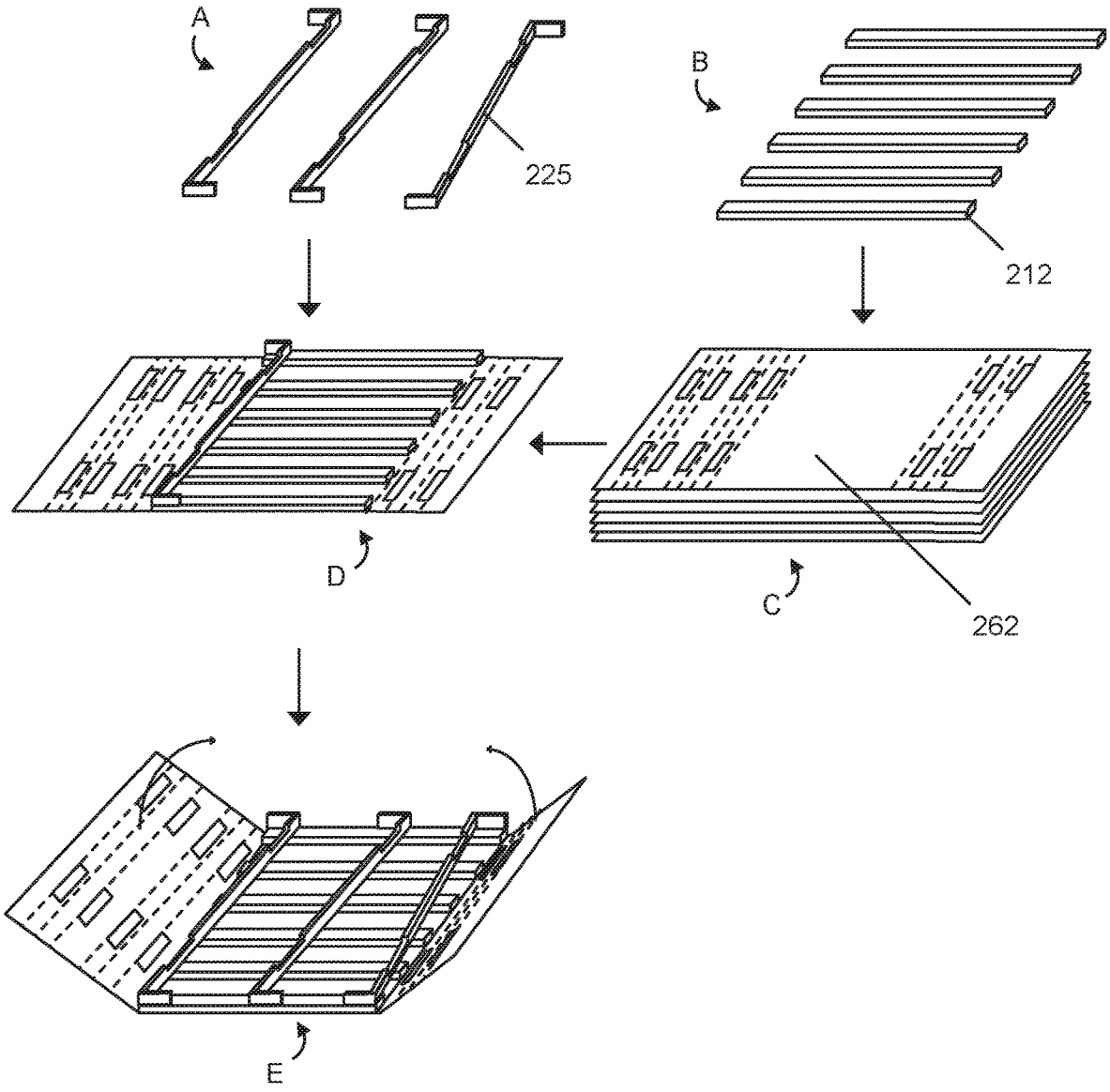
FIG. 7 illustrates a perspective view of a method according to an embodiment of the invention for fabricating a pallet assembly as shown in FIG. 5 and FIG. 6.

FIG. 7 illustrates a perspective view of a method according to an embodiment of the invention for fabricating a pallet assembly as shown in FIG. 5 and FIG. 6. As shown by "A", stringer elements 225 are assembled together, i.e., end portions are connected to linear element. Board elements 212 are picked up, such as by robotic suction cups shown by "B". Adhesive such as glue is applied to a corrugated sheet 262 positioned in a stack of sleeve components shown by "C". Each board element 212 of the plurality are glued to the sheet. As shown by "D", stringer elements 225 are secured to the board elements 212. Adhesive is applied to the stringer elements 225 and the corrugated sheet 262 is folded such that it is positioned around to cover both the board elements 212 and stringer elements 225 (shown by "E"). It is contemplated that the sheet 262 is folded such that the seam is located between stringer elements 225.

Figure 8:
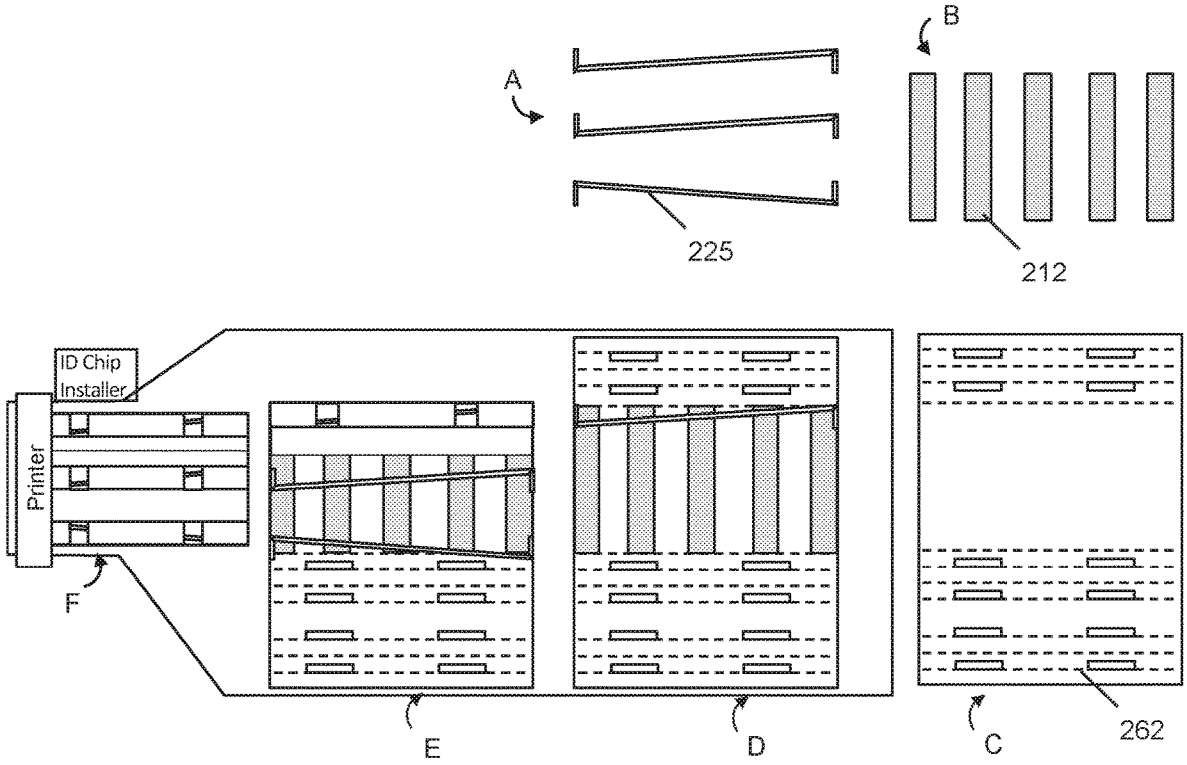
FIG. 8 illustrates a top view of a method according to an embodiment of the invention for fabricating a pallet assembly as shown in FIG. 5 and FIG. 6.

FIG. 8 illustrates a top view of another method according to an embodiment of the invention for fabricating a pallet assembly as shown in FIG. 5 and FIG. 6. As shown by "A", stringer elements 225 are assembled together, i.e., end portions are connected to linear element. Board elements 212 are picked up, such as by robotic suction cups shown by "B". Adhesive such as glue is applied to a corrugated sheet 262 positioned in a stack of sleeve components shown by "C". Each board element 212 of the plurality are glued to the sheet. As shown by "D", stringer elements 225 are secured to the board elements 212. Adhesive is applied to the stringer elements 225 and the corrugated sheet 262 is folded such that it is positioned around to cover both the board elements 212 and stringer elements 225 shown by "E". It is contemplated that the sheet 262 is folded such that the seam is located between stringer elements 225. As shown by "F", the assembled pallet goes to a chip inserter device and a printer device.

The chip inserter device positions a tracking device or tracking element such as an identification (ID) chip on the pallet assembly. The ID chip, such as an RFID tag, may be used to track the pallet assembly. A RFID tag, or radio frequency identification tag, is a type of electronic identification that uses radio frequency signals to read information. A tracking device may be applied to each component, larger groupings of components, or the fully assembled pallet. The tracking device can communicate a variety of information, for example, certification of the maximum weight the pallet is capable of supporting, origin, and destination of the product associated with a particular pallet along with the location at any given moment in time. It is also contemplated that the ID chip may include data read by a printer device. This data may identify the content to be selected from a database and printed on the pallet assembly.

The printer device prints content (print element) on the pallet assembly. For example, the sleeve component may include, if desired, surfaces for informational purposes such as by being decorated by processes of printing, laminating, stamping, spraying, etc. and can offer benefits such as bar coding, assembly instructions, and advertising. The pallet assembly including printed sleeve component can be used as a point-of-purchase display that communicates display information, such as a barcode or advertising and so on, about product or articles carried on the pallet.

Figure 9:
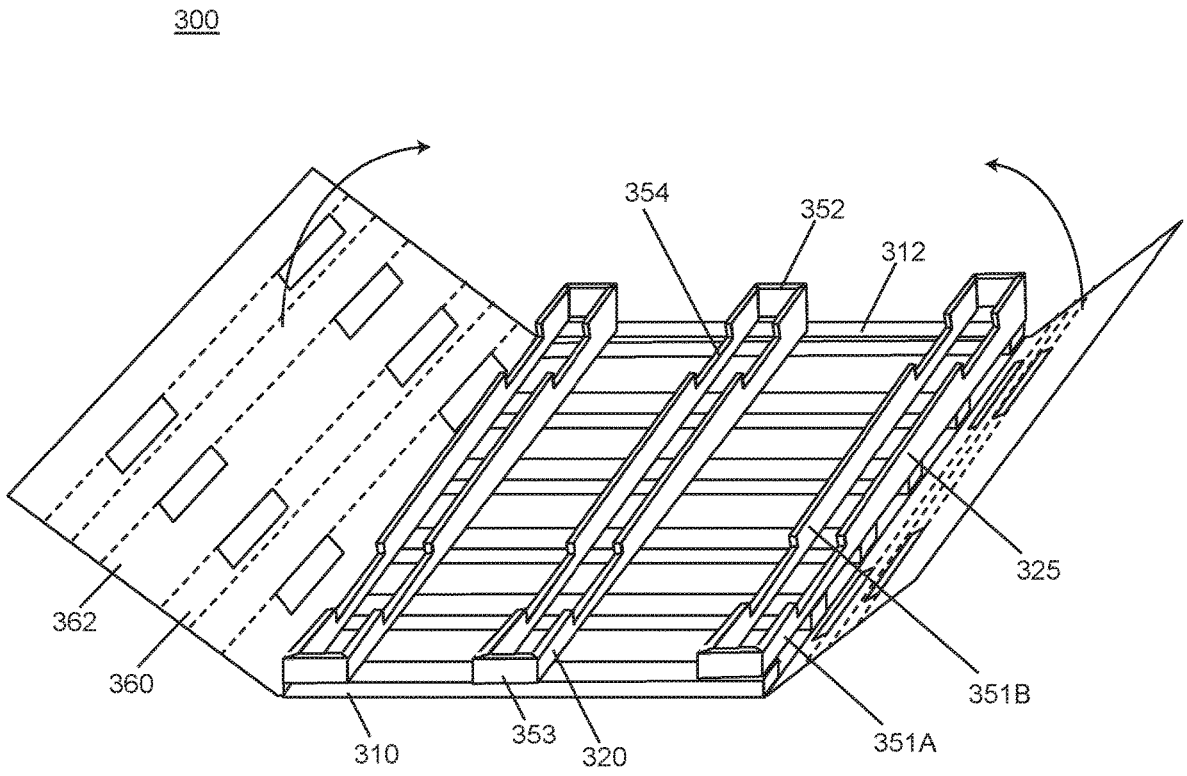
FIG. 9 illustrates a perspective view of a pallet assembly according to an embodiment of the invention.
Figure 10:
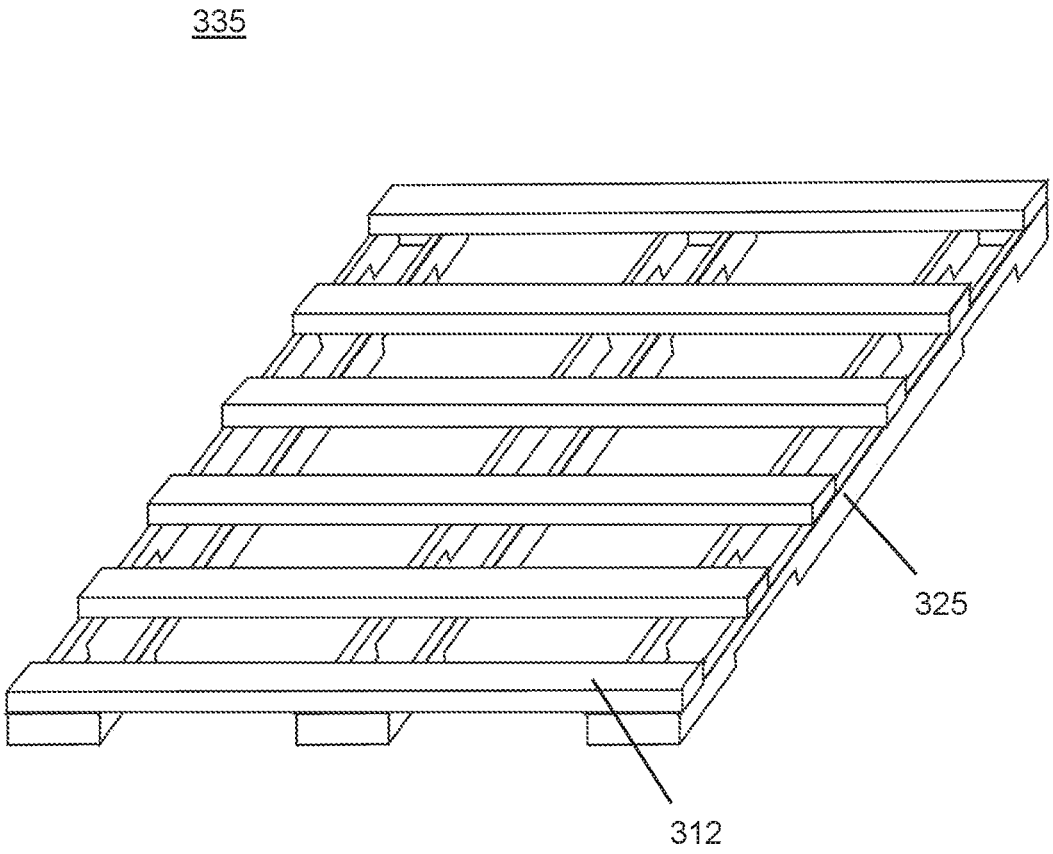
FIG. 10 illustrates a top perspective view of a connected unit according to an embodiment of the invention.

FIG. 9 illustrates a perspective view of a pallet assembly 300 according to an embodiment of the invention. Base component 310 comprises a plurality of board elements 312. Support components 320 comprise stringer elements 325, which are adhered to the plurality of board elements 312—one positioned in the center of the base component 310 and the others positioned at or along an edge of the base component 310. The plurality of board elements 312 and stringer elements 325 are adhered to create connected unit 335 as shown in FIG. 10. Turning back to FIG. 9, each stringer element 325 includes two linear elements 351A, 351B each connected to end portions 352, 353 forming a box-like structure. Linear elements2 351A, 351B each include notches 354. Sleeve component 360 is a die cut corrugated sheet 362 that is placed on a top surface of the plurality of board elements 312 and folded to encase each string element 325.

Figure 11:
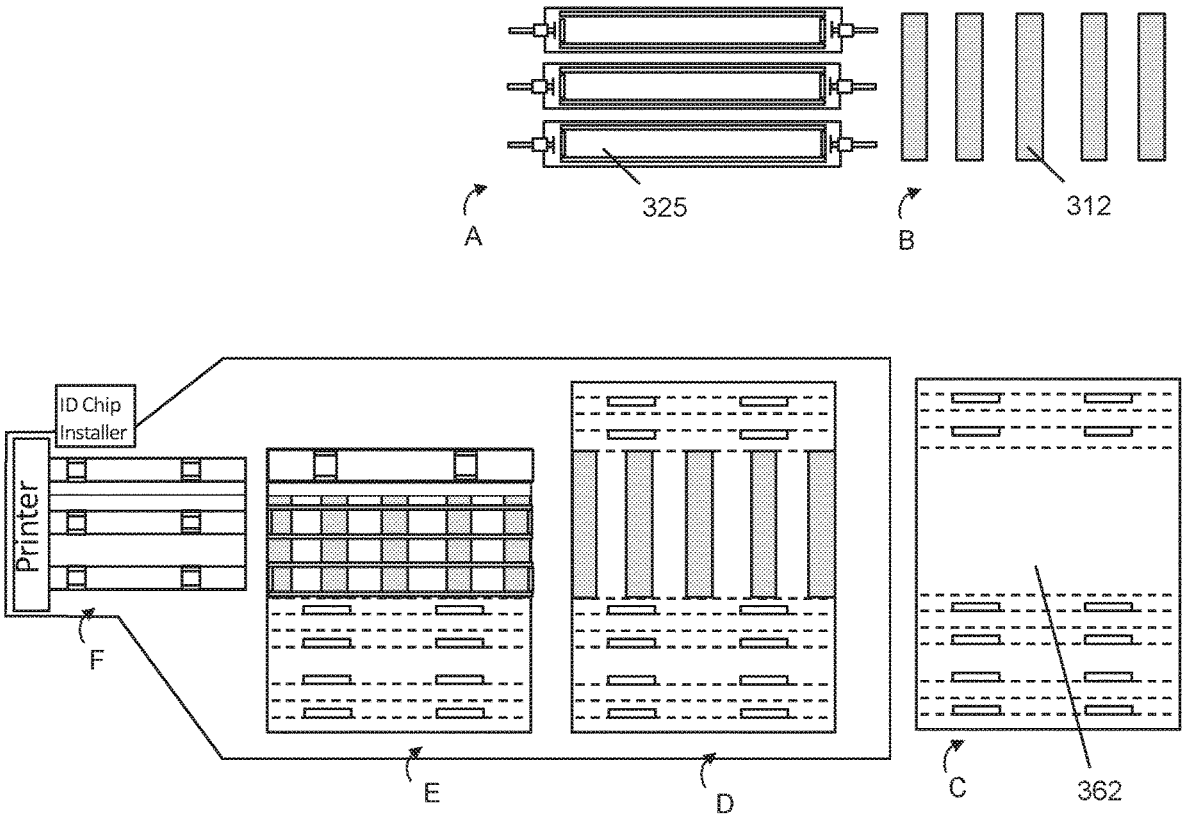
FIG. 11 illustrates a perspective view of a method according to an embodiment of the invention for fabricating a pallet assembly as shown in FIG. 9 and FIG. 10.

FIG. 11 illustrates a perspective view of a method according to an embodiment of the invention for fabricating a pallet assembly as shown in FIG. 9 and FIG. 10. As shown by "A", stringer elements 325 are assembled together, i.e., end portions are connected to linear elements. The spacing between the stringer elements and length of the stringer elements can vary to determine the pallet size. Stringer elements are assembled by feeding the linear elements and end portions into a jig and compressed together while secured together, e.g., glued, as shown by "A". It is contemplated that a jig or custom-made tool may be used to control the location and/or motion during construction of the pallet assembly.

Board elements 312 are picked up, such as by robotic suction cups shown by "B". Glue adhesive is applied to a corrugated sheet 362 positioned in a stack of sleeve components shown by "C". Each board element 312 of the plurality are glued to the sheet as shown by "D". As shown in FIG. 11, the corrugated sheet 362 is positioned such that the corrugation (i.e., ridges/grooves) of the sheet is parallel to the stringer elements 312. This is opposite from the corrugation as shown in FIG. 8, which is perpendicular to the stringer elements. It is contemplated that the corrugation of the corrugated sheet may be positioned in either direction.

Stringer elements 325 are secured to the board elements 312 as shown by "E". Glue adhesive is applied to the stringer elements 325 and the corrugated sheet 362 is folded such that it is positioned around to cover both the board elements 312 and stringer elements 325. It is contemplated that the sheet 362 is folded such that the seam is located between stringer elements 325. As shown by "F", the assembled pallet mat be transported to a chip inserter device and a printer device as described more fully with respect to FIG. 8 above.

Figure 12:
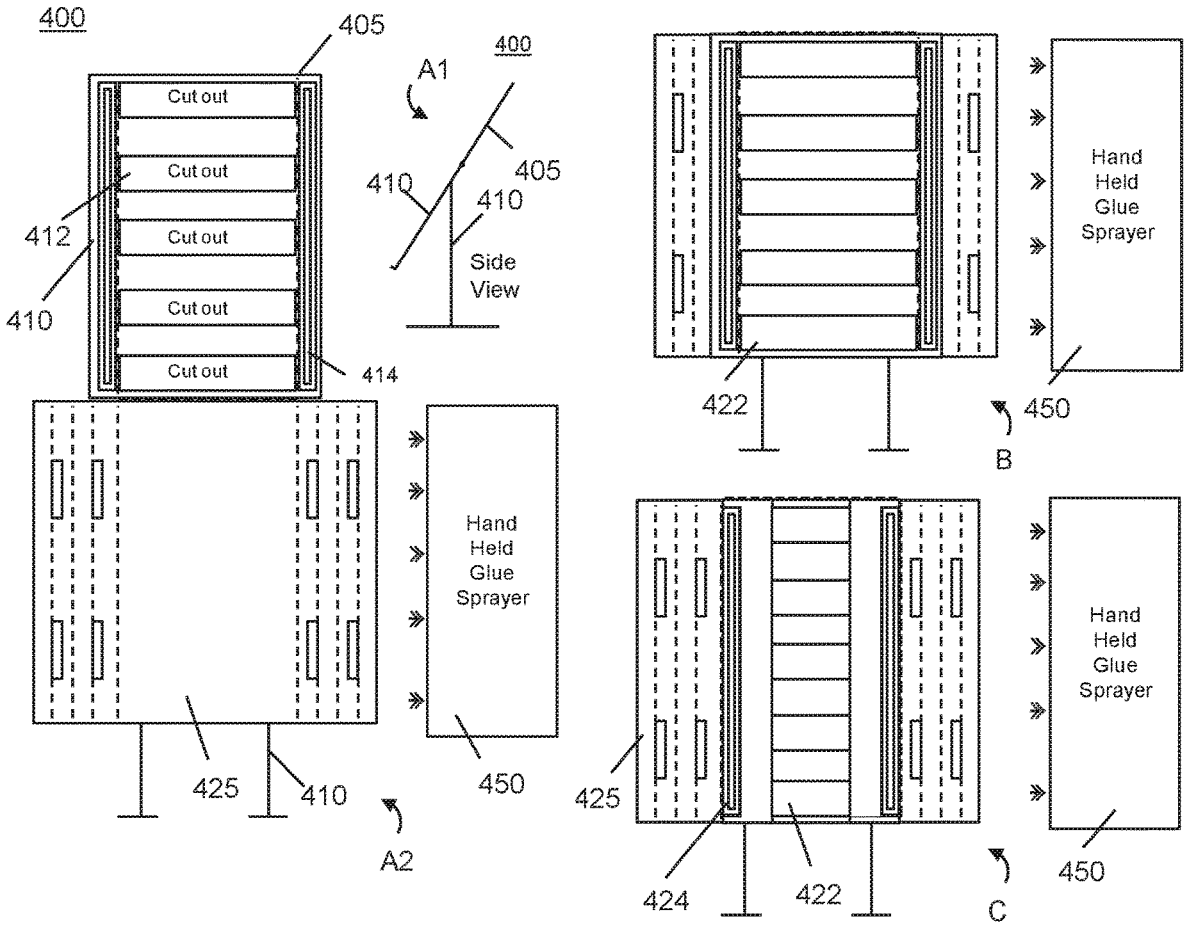
FIG. 12 illustrates a perspective view of another method according to an embodiment of the invention for fabricating a pallet assembly as shown in FIG. 9 and FIG. 10.

FIG. 12 illustrates a top view of another method according to an embodiment of the invention for fabricating a pallet assembly. A jig device 400 or custom-made tool is used to control the location and/or motion during construction of the pallet assembly. A side view of the jig device is shown by "A1" and a front view of the jig device is shown by "A2". The jig device 400 includes a template 410 attached via a hinge to a base 405. The template 410 includes areas 412 that are cut-out of the template 410. Areas 412 provide the location for adhesive in order to attach one or more base components. The template 410 also includes placement indicators 414 communicating the location for each support component. A corrugated sheet 425 is placed on the base 405 of the template 410. The template 410 is hingedly attached to the base 405 so that it may be folded down over sheet 425 as shown by "B". Glue is applied using a sprayer device 450 to the sheet 425 in order to secure base components, or board elements 422. Glue is then applied by the sprayer device 450 to the board elements 422 and the support components, or stringer elements 424 are applied. After the stringer elements 424 are adhered to the board elements 422, the template 410 is folded upwards (not shown). The sprayer device 450 applies glue adhesive to the stringer elements 424 and board elements 422 as shown by "C" and the corrugated sheet 425 folded to complete the pallet assembly.

Figure 13:
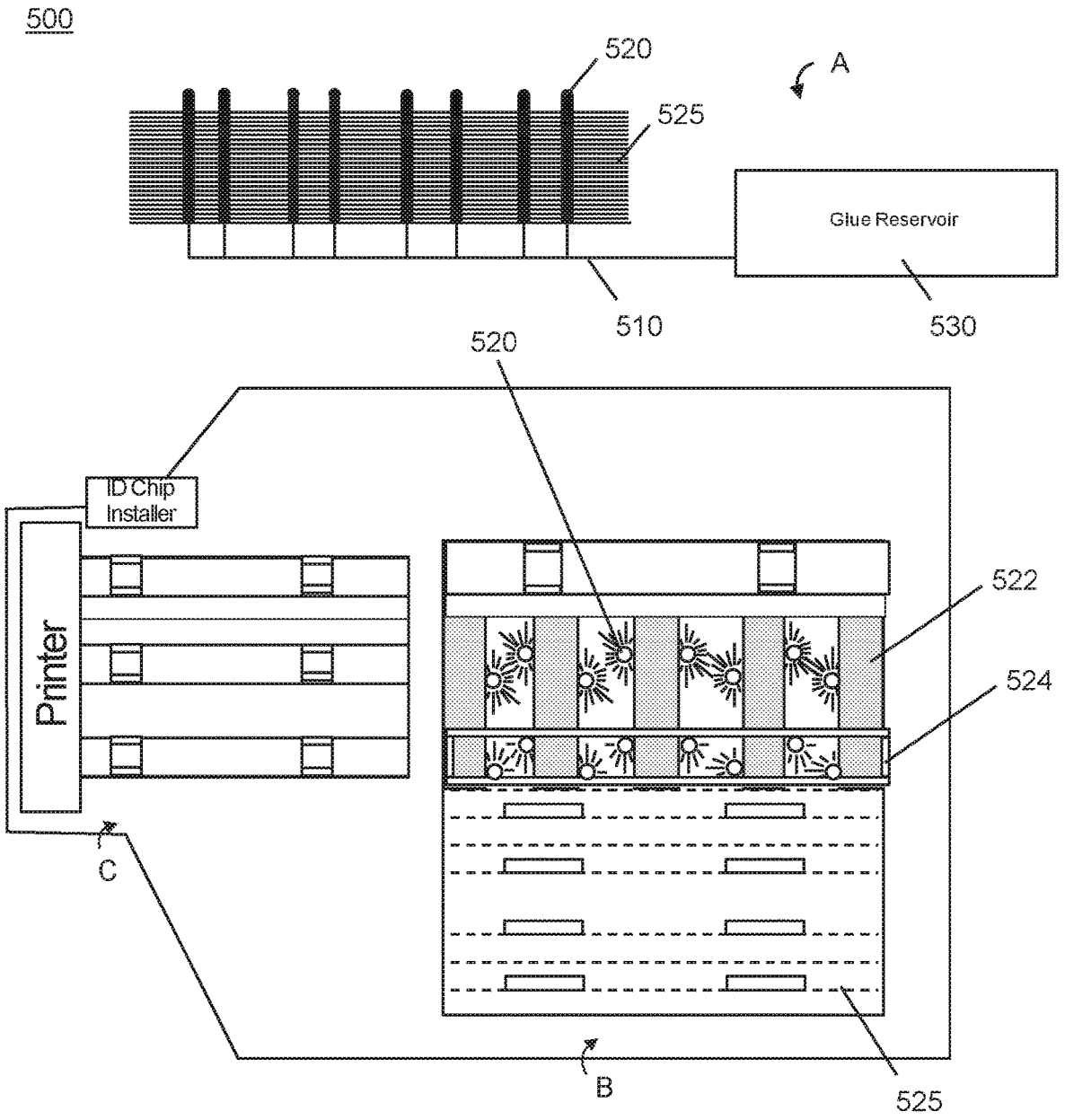
FIG. 13 illustrates a perspective view of another method according to an embodiment of the invention for fabricating a pallet assembly.

FIG. 13 illustrates a perspective view of another method according to an embodiment of the invention for fabricating a pallet assembly. A custom-made tool 500 or jig controls the location and/or motion during construction of the pallet assembly. The custom-made tool 500 shown by "A" includes a fixture 510 including a plurality of pins 520 or spikes connected to a glue reservoir 530. The pins 520 locate each sheet by protruding through holes within each sheet 525 of the stack. And the number of pins 520 varies depending on the required specifications. For example, as shown in FIG. 13, sixteen pins are grouped in pairs.

While the sheet 525 is secure by pins 520, glue is dispensed from the glue reservoir 530 through the fixture 510 and out through pins 520 onto a surface of the sheet 525. Each pin 520 comprises two ends—one that is connected to a glue reservoir 530 and the other end exposed above the top sheet of the stack. The pins 520 can deliver glue to a surface of the corrugated sheet 525 prior to position of one or more base components. And the pins 520 can deliver glue to a surface of the base components onto which the support components are placed. Lastly, the pins 520 can deliver glue to the based components and support components before a portion of the corrugated sheet is folded and secured.

As shown by "B", board elements 522 are located and glued on a surface of the exposed sheet 525 of the stack. The board elements 522 are positioned in voids located between pins 520. Stringer elements 524 are then located and glued on a surface of the board elements 522. The corrugated sheet 525 is then folded over clearing the pins 520 of the fixture 510 and glued to cover the board elements 522 and stringer elements 524. The assembled pallet is then lifted from the pins and removed from the fixture 510 and sent to a compression roller (not shown) to compress and secure together the components and elements of the pallet assembly. However, it is contemplated that the pallet assembly may be compressed prior to removal from the fixture 510.

The assembled pallet is removed from the fixture 510 and sent to a chip inserter device and printer device shown by "C" in FIG. 13. The chip inserter device positions a tracking device or tracking element such as an identification (ID) chip on the pallet assembly. It is also contemplated that the ID chip may include data read by the printer device, for example, to identify the content to be selected from a database and printed on the pallet assembly. The printer device prints content on the pallet assembly, for example, bar coding, assembly instructions, and advertising.

Figure 14:
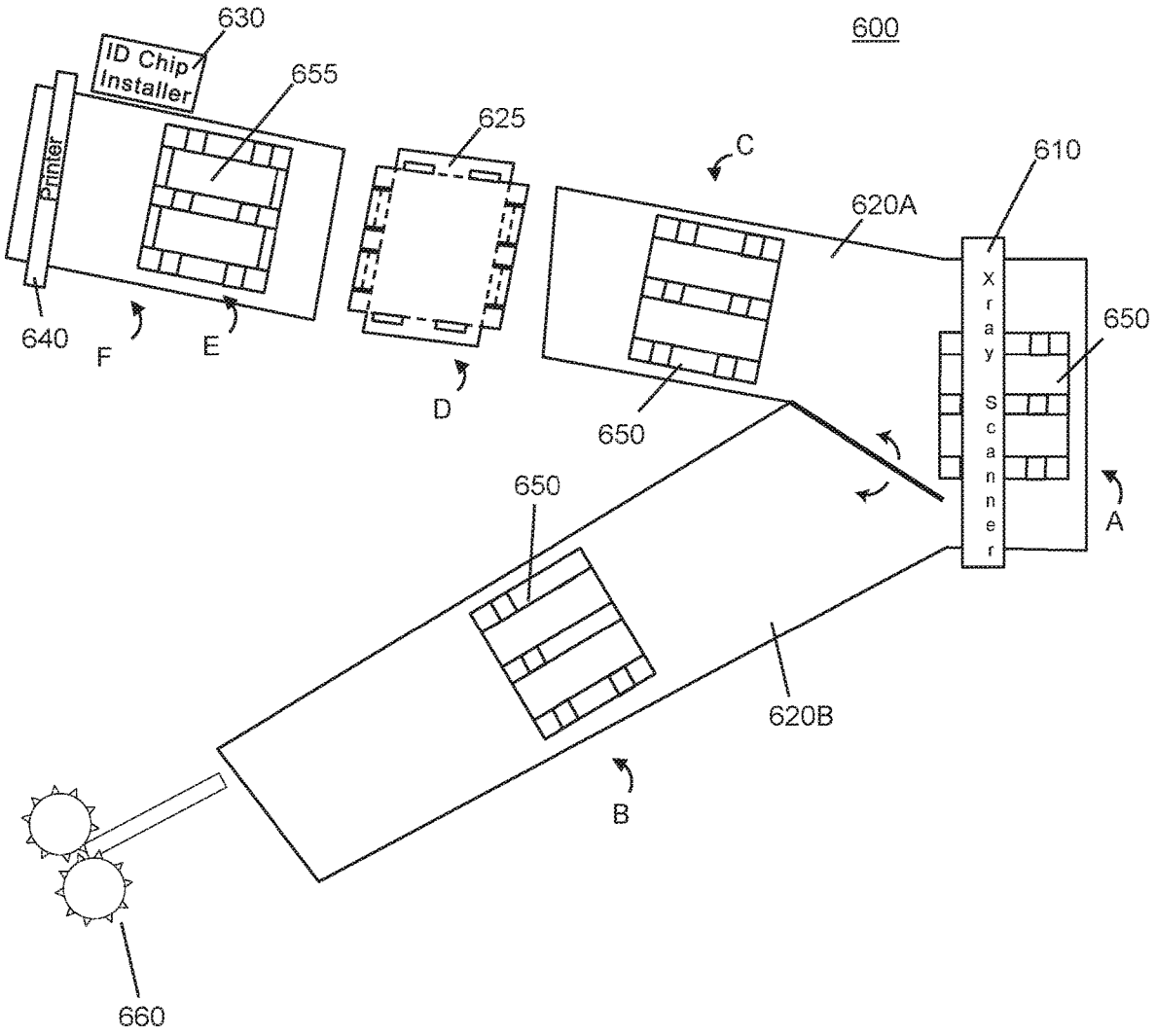
FIG. 14 illustrates a top view of a method for recycling a pallet according to an embodiment of the invention.

FIG. 14 illustrates a top view of a method for recycling a pallet according to an embodiment of the invention. A machine 600 includes an X-ray scanning device 610, two conveyer systems 620A, 620B, a plurality of robotic arms (not shown), and a chip inserter device 630 and printer device 640.

As shown by "A", a pallet assembly 650 may be inserted into the X-ray device 610 in order to determine if any components are damaged. For example, if one or more base components and/or support components are damaged, the pallet may be sent on conveyor system 620B to a grinder/bailer device 660 and recycled as shown by "B". If no components are damaged, the pallet assembly may be sent on conveyor system 620A for a new or second sleeve component. As shown by "C", the pallet assembly is picked and placed (such as by robotic arms—not shown). The pallet assembly is moved and placed on top of a new sleeve component as shown by "D". Glue adhesive is applied to a second sleeve component 625 of a stack of sleeve components. The sleeve component is then folded such that it is positioned around to cover the pallet assembly, i.e., sleeve component, base components, support components as shown by "E". The new sleeve component is glued to the pallet assembly creating a new or second pallet assembly 655. The new assembled pallet 655 may then be sent to a chip inserter device 630 printer device 640 shown by "F" in FIG. 14.

Figure 15:
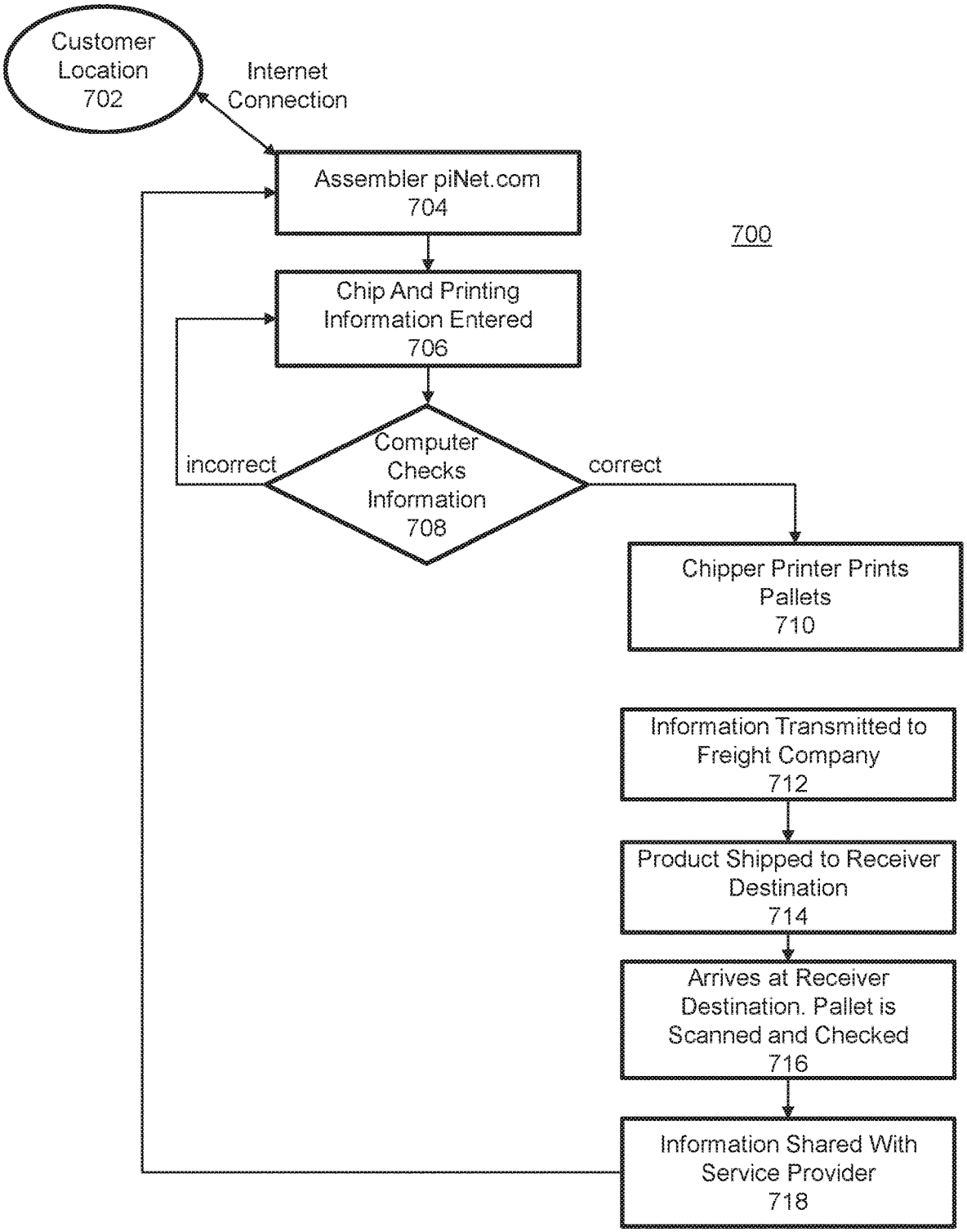
FIG. 15 is a flow chart of steps for an assembled pallet according to an embodiment of the invention.

FIG. 15 is a flow chart of steps for an assembled pallet according to an embodiment of the invention. FIG. 15 is a flow chart 700 of steps that may be performed with an assembled pallet according to an embodiment of the invention. The chip inserter device positions an identification (ID) chip on the pallet assembly. The ID chip, such as an RFID tag, may be used to track the pallet assembly. It is also contemplated that the ID chip includes data read by the printer device. This data may identify the content to be selected from a database and printed on the pallet assembly. As shown in FIG. 15, the steps performed are in communication between a provider and purchaser identified by customer location 702. Providers include, for example, persons or entities that assemble, use, sell, or distribute pallets. A purchaser contacts the provider such as through an Internet-based service sponsored by the provider 704. The Internet-based service includes a user interface that allows the purchaser to identify details of the order such as the number of pallets, maximum weight requirement of each pallet, content for printing on the pallet, and chip information such as freight company identifier, delivery address of a recipient, cargo weight, number of units, name of each unit, etc, 706. A processor receives and reviews for accuracy the details of the order 708. If the details are inaccurate or incorrect, the user is prompted to correct or verify the information entered. If the details are accurate or correct, the order is fulfilled. Hence one or more chip tracking elements, based on the details provided by the user, are selected and inserted on the pallet assembly by the chip inserter device and a print element (content) is printed on the pallet assembly from a printer device 710. The Internet-based service may also communicate with one or more freight companies 712. For example, the Internet-based service may alert a freight company, as provided by the user, to pick up and deliver to the recipient the pallet assembly. The freight company delivers the pallet assembly 714. It is contemplated that a user may access the Internet-based service for information such as the exact location of the pallet assembly as provided by the tracking element. For example, the tracking element as part of a Global Positioning System (GPS) to provide location and time information of a pallet assembly anywhere on or near the Earth. Upon arrival, the pallet assembly is scanned and checked-in by the recipient 716. For example, the scanned information of the tracking element can be used to confirm accuracy of the delivery address of the recipient, cargo weight, number of units, name of each unit, etc. This scanned information can then be communicated with the Internet-based service 718. And available for sharing with others such as providers, purchasers, freight companies, etc.

Advantageously, the Internet-based service manages and maintains records of information related to each pallet assembly and can be used for many contemplated uses, for example, automatic inventory control. It is further contemplated that the Internet-based service can work in conjunction with other services, for example, accounting software packages such as QuickBooks that is developed and marketed by Intuit.

While the present inventions and what is considered presently to be the best modes thereof have been described in a manner that establishes possession thereof by the inventors and that enables those of ordinary skill in the art to make and use the inventions, it will be understood and appreciated that there are many equivalents to the exemplary embodiments disclosed herein and that myriad modifications and variations may be made thereto without departing from the scope and spirit of the inventions, which are to be limited not by the exemplary embodiments but by the appended claims.

The invention claimed is:

1. A pallet assembly fabricated of a sheet of material for receiving product, comprising:

one or more base components forming a platform;

two or more support components positioned on an underside of the platform, wherein each support component comprises one or more linear elements and two end portions, each of the one or more linear elements extending between a first end and a second end, the first end portion connected to the first end of the linear element and the second end portion connected to the second end of the linear element, the first end portion parallel to the second end portion and the one or more linear elements connected to each end portion at an angle; and a sleeve component including a plurality of flaps hingedly attached to a top portion, the sleeve component folded such that it is positioned around to cover both the one or more base components and the two or more support components, with one or more first flaps tucked under a bottom of the pallet assembly, one or more second flaps covering the sides of the pallet assembly, and one or more third flaps covering exposed ends of the one or more base components and the two or more support components.

2. The pallet assembly according to claim 1, wherein the one or more base components are wood boards.

3. The pallet assembly according to claim 1, wherein the one or more linear elements include notches configured to receive forklift tines.

4. The pallet assembly according to claim 1, wherein the sleeve component is a die cut corrugated paperboard sheet.

5. A method for fabricating a pallet assembly comprising the steps of:

providing a sleeve component comprising a corrugated sheet;

applying glue to portions of the sleeve component;

positioning one or more base components to the glued portions of the sleeve component;

applying glue to portions of the one or more base components;

positioning two or more support components to the glued portions of the base components, wherein each support component comprises one or more linear elements and two end portions, the first end portion connected to a first end of the linear element and the second end portion connected to a second end of the linear element, the first end portion parallel to the second end portion and the one or more linear elements connected to each end portion at an angle;

applying glue to portions of the one or more support components and portions of the sleeve component;

folding the sleeve component so that portions of the sleeve component cover all or a portion of both the one or more base components and the two or more support components to form the pallet assembly;

transporting the pallet assembly to a chip inserter device, wherein the chip inserter device positions an identification (ID) chip on the pallet assembly; and moving the pallet assembly to a printer device, wherein the printer device prints content on the sleeve component.

6. The method according to claim 5 further comprising the steps of:

utilizing an Internet-based service including a user interface to identify details of an order;

selecting and inserting on the pallet assembly one or more chip tracking elements;

using the Internet-based service provider to alert a freight company to pick up and deliver to the recipient the pallet assembly;

accessing the Internet-based service for information such as the exact location of the pallet assembly as provided by the identification (ID) chip; and scanning information to the Internet-based service by a recipient of the pallet assembly.

7. The method according to claim 5 wherein the positioning step further comprises the step of connecting one or more linear elements with end portions to form the support component.

8. The method according to claim 5 wherein the connecting step further comprises the steps of:

gluing the one or more linear elements with the end portions; and compressing together the one or more linear elements and the end portions to form the support component.

9. The method according to claim 5 wherein the content is a bar code.

10. The method according to claim 5 further comprising the steps of:

using an x-ray scanning device to determine damage of the pallet assembly;

providing a second sleeve component comprising a second corrugated sheet;

applying glue to portions of the second sleeve component;

positioning the pallet assembly to the glued portions of the second sleeve component;

folding the second sleeve component so that portions of the second sleeve component cover all or a portion of the pallet assembly.

11. The pallet assembly according to claim 1, wherein each support component comprises one linear element connected to each end portion at 45°.

12. The pallet assembly according to claim 1, wherein each support component comprises two linear elements each connected to each end portion at 90°.

* * * * *